US006522264B1

(12) United States Patent
Stewart

(10) Patent No.: US 6,522,264 B1
(45) Date of Patent: Feb. 18, 2003

(54) AIRPORT PARKING COMMUNICATION SYSTEM

(75) Inventor: Gregory M. Stewart, Steilacoom, WA (US)

(73) Assignee: IDmicro, Inc., Tacoma, WA (US)

( * ) Notice: Subject to any disclaimer, the term of this patent is extended or adjusted under 35 U.S.C. 154(b) by 0 days.

(21) Appl. No.: 09/653,515

(22) Filed: Aug. 31, 2000

Related U.S. Application Data

(60) Provisional application No. 60/152,511, filed on Sep. 2, 1999.

(51) Int. Cl.[7] ..... G08B 21/00

(52) U.S. Cl. ..... 340/945; 340/572.1; 340/932.2; 340/933

(58) Field of Search ..... 340/945, 572.1, 340/988, 932.2, 933, 941, 994

(56) References Cited

U.S. PATENT DOCUMENTS

| | | | | | |
|---|---|---|---|---|---|
| 4,990,757 | A | * | 2/1991 | Edwards et al. | 235/384 |
| 5,168,451 | A | | 12/1992 | Bolger | 364/436 |
| 5,710,557 | A | | 1/1998 | Schuette | 340/932.2 |
| 5,737,710 | A | * | 4/1998 | Anthonyson | 701/1 |
| 5,751,973 | A | * | 5/1998 | Hassett | 395/213 |
| 6,052,068 | A | * | 4/2000 | Price R-W et al. | 340/933 |
| 6,112,152 | A | * | 8/2000 | Tuttle | 701/115 |
| 6,163,275 | A | * | 12/2000 | Janman | 340/988 |
| 6,249,227 | B1 | * | 6/2001 | Brady et al. | 340/572.1 |

FOREIGN PATENT DOCUMENTS

| | | |
|---|---|---|
| EP | 0 725 377 A2 | 8/1996 |
| JP | 08091535 A2 | 4/1996 |
| JP | 11-159179 | 6/1999 |

* cited by examiner

*Primary Examiner*—Benjamin C. Lee
*Assistant Examiner*—Phung Nguyen
(74) *Attorney, Agent, or Firm*—Christensen O'Connor Johnson Kindness PLLC

(57) ABSTRACT

An improved airport parking communication system is provided. When a customer arrives at a parking lot, the customer is provided a radio frequency identification tag. The customer's name and vehicle slot number are electronically written onto the radio frequency identification tag as well as entered into a parking system database. This occurs before the customer enters the courtesy bus for the terminal of the airport. When the customer returns to the airport and gathers their luggage, the customer moves to an island that includes readers that read the information stored in the radio frequency identification tag carried by the customer. The information is transmitted to the parking lot, where the information is used to dispatch a courtesy bus to retrieve the customer, or to communicate with a courtesy bus already en route. This information is also displayed to an attendant so that the attendant may use the information to retrieve the customer's vehicle and to deliver the customer's vehicle to a delivery area. In this manner, the customer's vehicle will be waiting for the customer when the customer arrives at the parking lot. The customer need not take any other action than carrying the RFID tag to the island to be retrieved.

20 Claims, 10 Drawing Sheets

AIRPORT PARKING COMMUNICATION SYSTEM

CROSS-REFERENCE TO RELATED APPLICATIONS

This application claims the benefit of U.S. Provisional Application No. 60/152,511, filed Sept. 2, 1999, which is expressly incorporated herein by reference.

FIELD OF THE INVENTION

This invention generally relates to the field of transportation systems and, more specifically, relates to an airport parking communication system.

BACKGROUND OF THE INVENTION

Many modem airports have perimeter parking lots where passengers park their vehicles while they travel to a remote destination and return. Many such parking lots are operated by commercial organizations, such as car rental and travel companies. The parking lots usually provide courtesy vans, or buses, for carrying customers from the perimeter parking lot to the airport, and from the airport to the perimeter parking lot. Transporting customers from the perimeter parking lot to the airport is relatively easy, because customers will congregate at the parking lot reception area located at the perimeter parking lot after parking their cars. However, knowing when to send a bus to pick a customer up at the airport and deliver them to the perimeter parking lot is considerably more difficult.

Previous systems and methods for determining when to pick a customer up at the airport have required customers to call the parking lot reception area to request a courtesy pick-up after they have arrived and collected their luggage. However, these systems require customers to transport their luggage to a telephone, make a telephone call, and wait for the courtesy bus to arrive. This process can be extremely burdensome and inconvenient for a customer. Accordingly, in light of these problems, there is a need for an airport communication system that can reduce the complexity of current parking lot notification systems and increase customer convenience.

SUMMARY OF THE INVENTION

The present invention solves the above-described problems by providing a method and system for providing customer arrival information to a parking lot attendant. According to an actual embodiment of the present invention, when a customer arrives at a parking lot, the customer is provided a radio frequency identification ("RFID") tag. The RFID tag contains information uniquely identifying the customer. For instance, the RFID tag may be encoded with a unique identification number or the customer's name and vehicle slot number may be electronically written onto the RFID tag. This information is then stored in a parking system database. This occurs before the customer enters the courtesy bus for the terminal of the airport.

When the customer returns to the airport and gathers their luggage, the customer moves to an island that includes readers that read the information stored in the RFID tag carried by the customer. The information is transmitted to the parking lot, where an attendant dispatches a courtesy bus, or communicates with one already en route, and delivers the customer's car to a delivery area. The customer need not take any other action than carrying the RFID tag to the island to be retrieved by a courtesy bus and have their car waiting for them at the parking lot.

According to an embodiment of the present invention, a RFID encoding system is provided for encoding information uniquely identifying the owner of a vehicle on a RFID tag, such as a unique identification number or the customer's name. Alternatively, the RFID encoding system may receive information identifying the location of a vehicle and encode this information on the RFID tag. Other information may also be encoded onto the RFID tag. This information is then stored in a parking system database. The encoded RFID tag is then issued to the customer.

An RFID interrogator is also provided in an embodiment of the present invention for decoding the information encoded on the RFID tag. The RFID interrogator is connected to one or more antennas mounted in an area where customers returning to the airport will congregate. The RFID interrogator is also connected to a computer for communicating with a base computer located at the remote parking lot. When a RFID tag is located proximately to the RFID interrogator and antennas, the RFID interrogator decodes the information encoded on the RFID tag and transmits this information to the base computer. The base computer then uses this information to dispatch a bus to retrieve the customer and return them to the parking lot where their vehicle is parked. The base computer may also locate the appropriate vehicle slot number and display this information to an attendant. The attendant may then use this information to retrieve the customer's car. According to an embodiment of the present invention, the base computer transmits information regarding the arrival time of the next courtesy bus to the interrogator computer, which may then be displayed for the benefit of the customer.

According to another embodiment of the present invention, an RFID interrogator is also placed proximate to the entrance of the parking lot. A customer is issued a RFID tag on their first visit to the parking lot that contains information uniquely identifying the RFID tag. When the customer returns to the parking lot on a subsequent trip, the RFID interrogator reads the information from the RFID tag as the customer enters the parking lot. The information contained in the RFID tag is then used to reference an entry in the parking system database relating to the customer. The database entry is updated to reflect that the customer has parked their car in that particular parking lot. When the customer returns to the airport, the RFID interrogator located at the airport reads the information from the customer's RFID tag and transmits this information to the parking lot base computer. A display may be provided at the entrance to the parking lot to inform the customer, that their RFID tag has been correctly interrogated. The base computer then uses this information to dispatch a bus to retrieve the customer and return them to the parking lot where their vehicle is parked.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
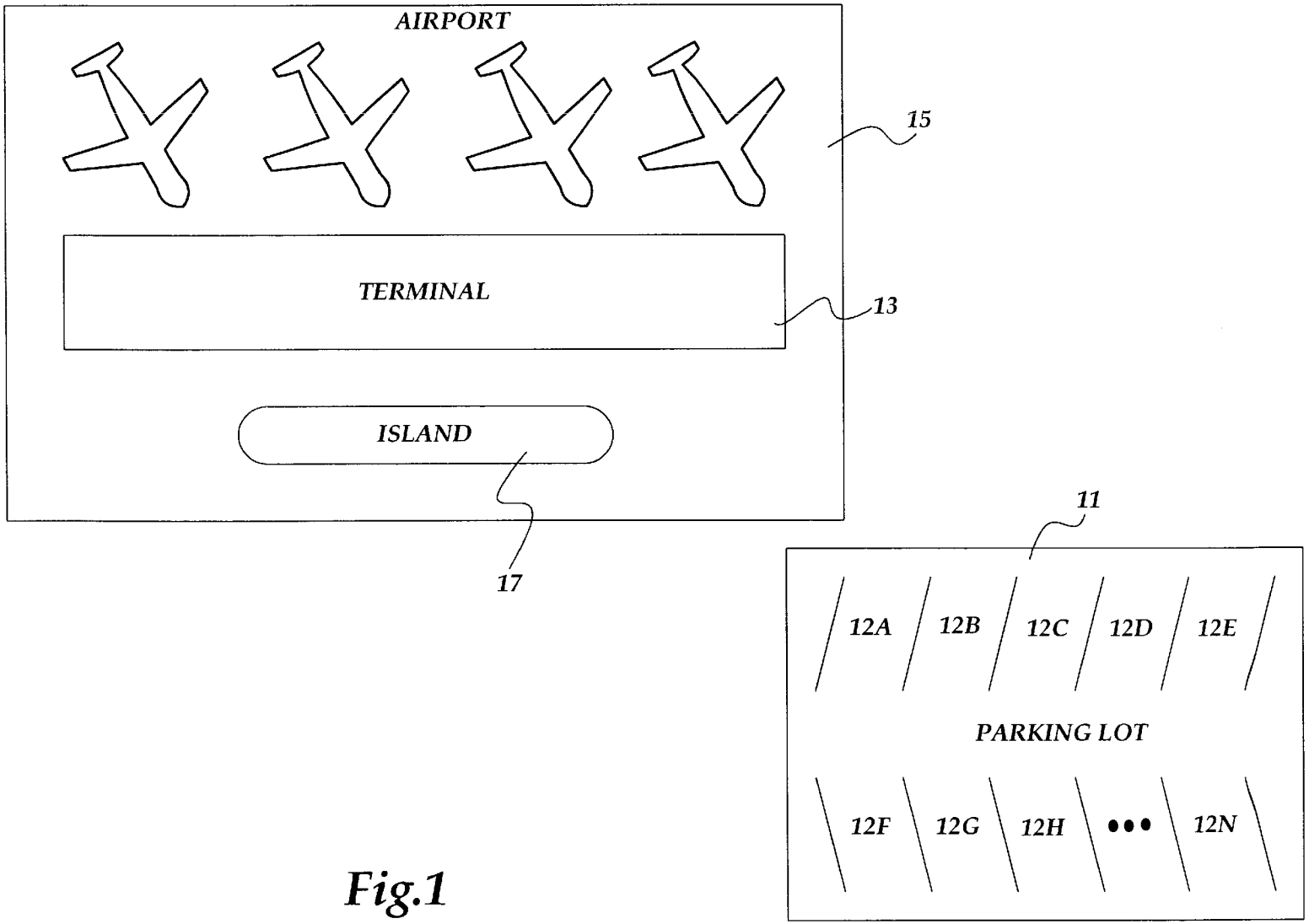
FIG. 1 is a block diagram illustrating an actual operating environment for aspects of the present invention.

As will be better understood from the following description, the present invention provides an improved airport parking communication system. Referring now to the figures, in which like numerals represent like elements, aspects of the present invention will be described. FIG. 1 shows an illustrative operating environment for aspects of the invention. In particular, when a customer arrives at parking lot 11, the customer is issued an RFID tag. The RFID tag contains information uniquely identifying the RFID tag. For instance, the tag may be encoded with a unique identification number 1 or may be manufactured containing a unique identification number 1. The customer's name and vehicle slot number 12A–12N may also be electronically written onto the tag. This information uniquely identifying the RFID tag is then stored in a parking system database. This occurs before the customer enters a courtesy bus for the terminal 13 of the airport 15. An RFID encoder for encoding a RFID tag is described below with respect to FIG. 2.

After the customer returns to the airport 15 and gathers his bag at the terminal 13, the customer proceeds to an island 17 that includes RFID interrogators that read the information stored in the RFID tag carried by the customer. An illustrative island 17 and RFID interrogator are described below with respect to FIGS. 3 and 4, respectively. The read information is transmitted to a base computer located at the parking lot 11. The information is used to dispatch a bus to pick up the customer at the island 17. The information may also displayed to an attendant so that the attendant may retrieve the customer's car from the appropriate vehicle slot number 12A–12N, and make the vehicle ready for the customer upon arrival. The base computer may also transmit information regarding the arrival time for the next courtesy bus to the island, where it may be displayed for the customer. An illustrative base computer will be described below with reference to FIG. 6.

Figure 2:
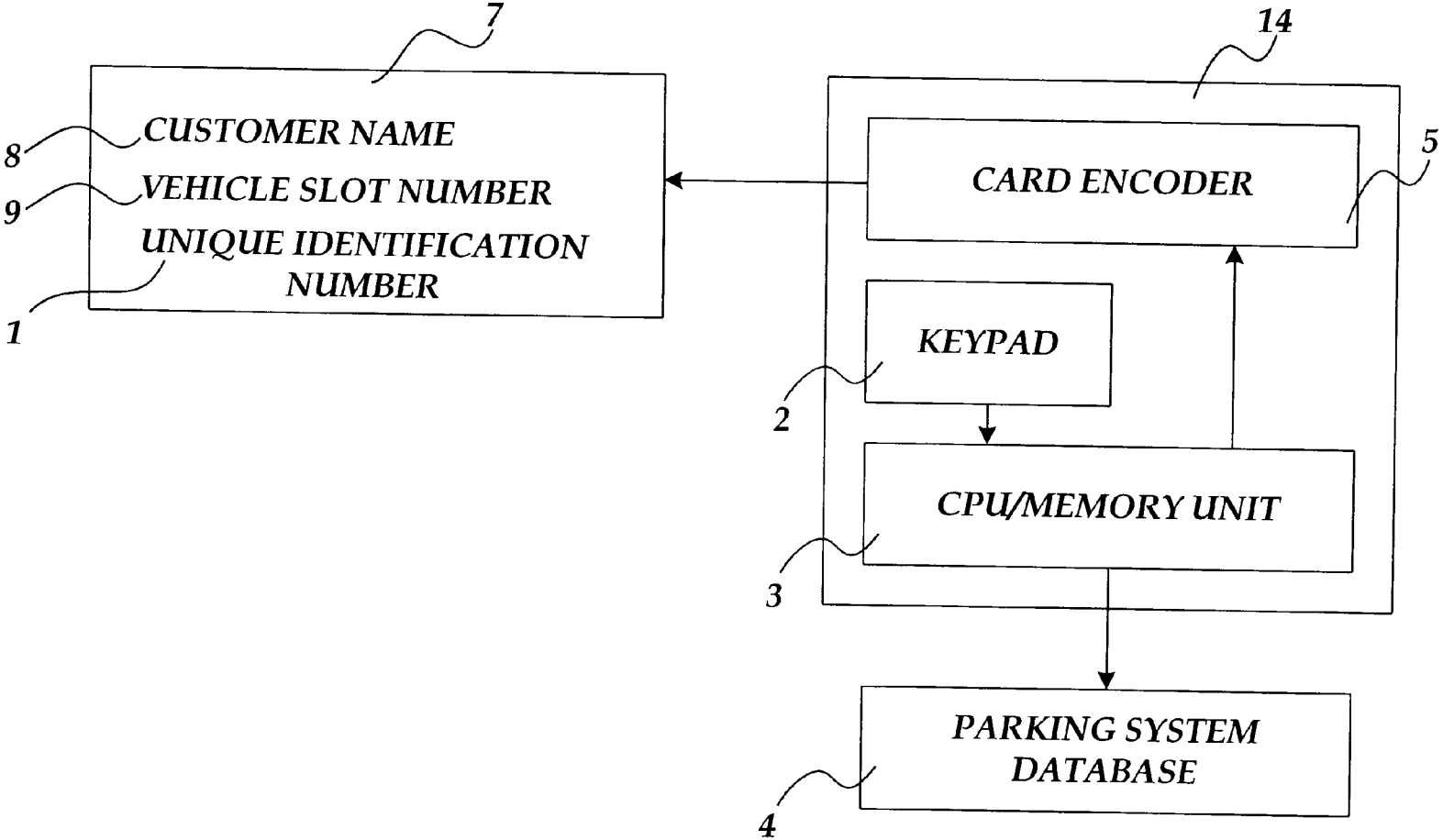
FIG. 2 is a block diagram showing a RFID tag and an RFID encoder utilized in an embodiment of the present invention.

Referring now to FIG. 2, an illustrative RFID encoder 14 will be described. When a customer arrives at the parking lot 11, the customer provides their name and the vehicle slot number 12A–12N in which they parked their vehicle. This information is entered into the RFID encoder 14 using a keypad 2. The cpu/memory unit 3 of the RFID encoder stores this information in a parking system database 4 for later retrieval. The arrival time of the customer at the parking lot may also be stored in the parking system database 4 for use in determining the parking fees owed by the customer upon their return. The cpu/memory unit 3 also controls the operation of a card encoder 5 for encoding the customer name 8 and vehicle slot number 9 onto an RFID card 7. Encoded RFID tags can be remotely interrogated (decoded) by RFID decoders, described below. The card is then issued to the customer and the customer takes the card with them.

According to an embodiment of the invention, the RFID tag 7 may be encoded with a unique identification number 1. When the customer arrives at the parking lot, they are issued the RFID tag 7 and no additional information is encoded on the RFID tag 7. The unique identification number 1 is used to identify the customer. As known to those skilled in the art, the RFID tag 7 may come from the manufacturer with a pre-encoded unique identification number 1, or the unique identification number 1 may be written to the RFID tag 7 by the RFID encoder 14.

Figure 3:
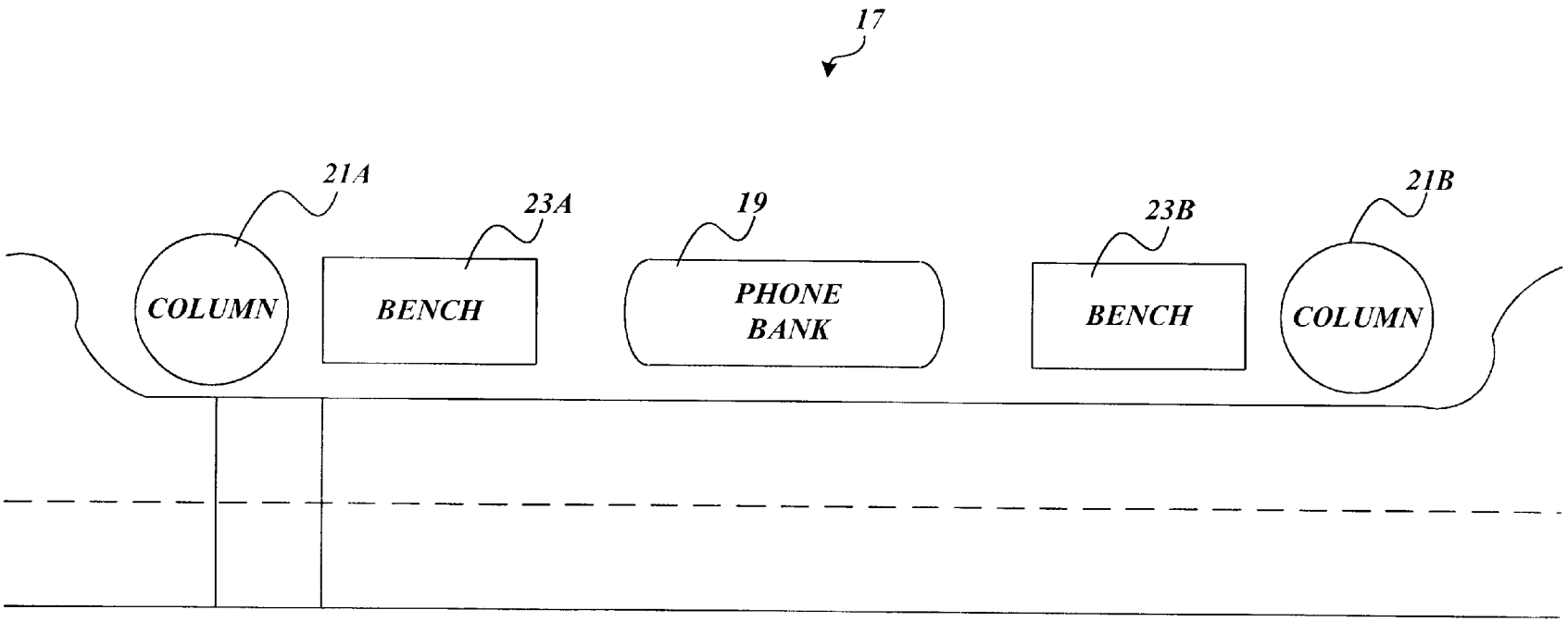
FIG. 3 is a block diagram showing further aspects of an actual operating environment for the present invention.

After the customer returns from their travels, the customer retrieves their luggage and proceeds to an island 17, as depicted in FIG. 3. The island 17 includes a bank of phones 19, columns 21A and 21B for supporting an overhead protective roof, and one or more benches 23A and 23B. As will be described in more detail below, an interrogator housing, a computer housing, and one or more antennas may be mounted on one of the columns 21B for decoding information from RFID tags located proximate to the column. Also, a display may be mounted above the bank of phones 19 for displaying information to the customer regarding the arrival time for the next bus.

Figure 4:
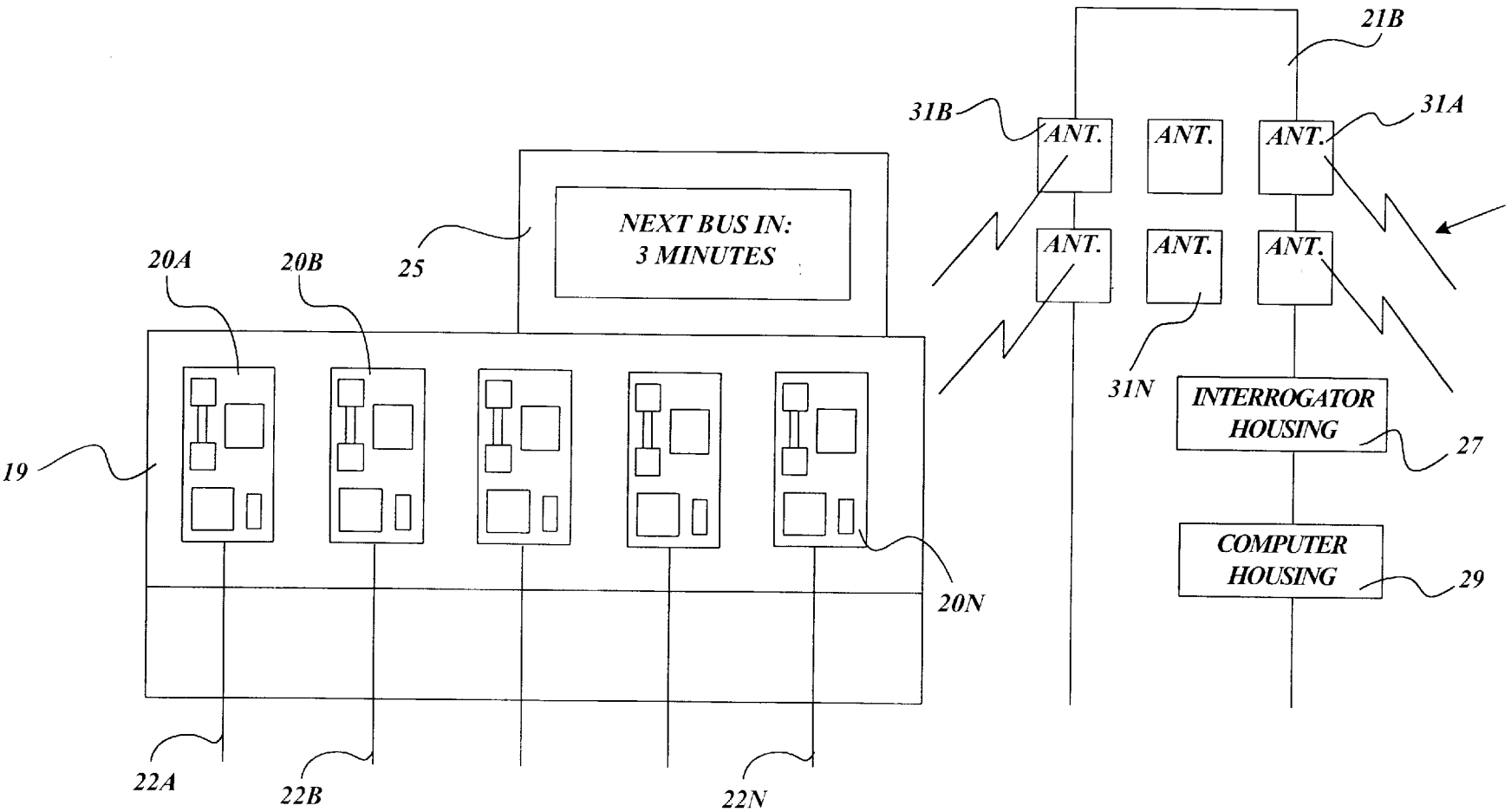
FIG. 4 is a block diagram showing an illustrative installation of an interrogator, a computer, antennas, and a display in the illustrative operating environment.

As illustrated in FIG. 4, the bank of phones 19 includes one or more telephones 20A–20N connected to the public switched telephone system by way of phone lines 22A–22N. A display 25 is mounted atop the bank of phones 19. The display is connected to the computer housing 29 and displays information regarding the arrival time of the next courtesy bus, advertising, or other information. Mounted on one of the columns 21B, are one or more antennas 31B–31N. The antennas 31A–31N emit a radio frequency signal 24 that, when reflected back to the antennas 31A–31N, allow the RFID interrogator to decode the information contained in an RFID tag located within the signal range of the antennas 31A–31N. Also mounted on the column 21B is an interrogator housing 27 and a computer housing 29.

Figure 5:
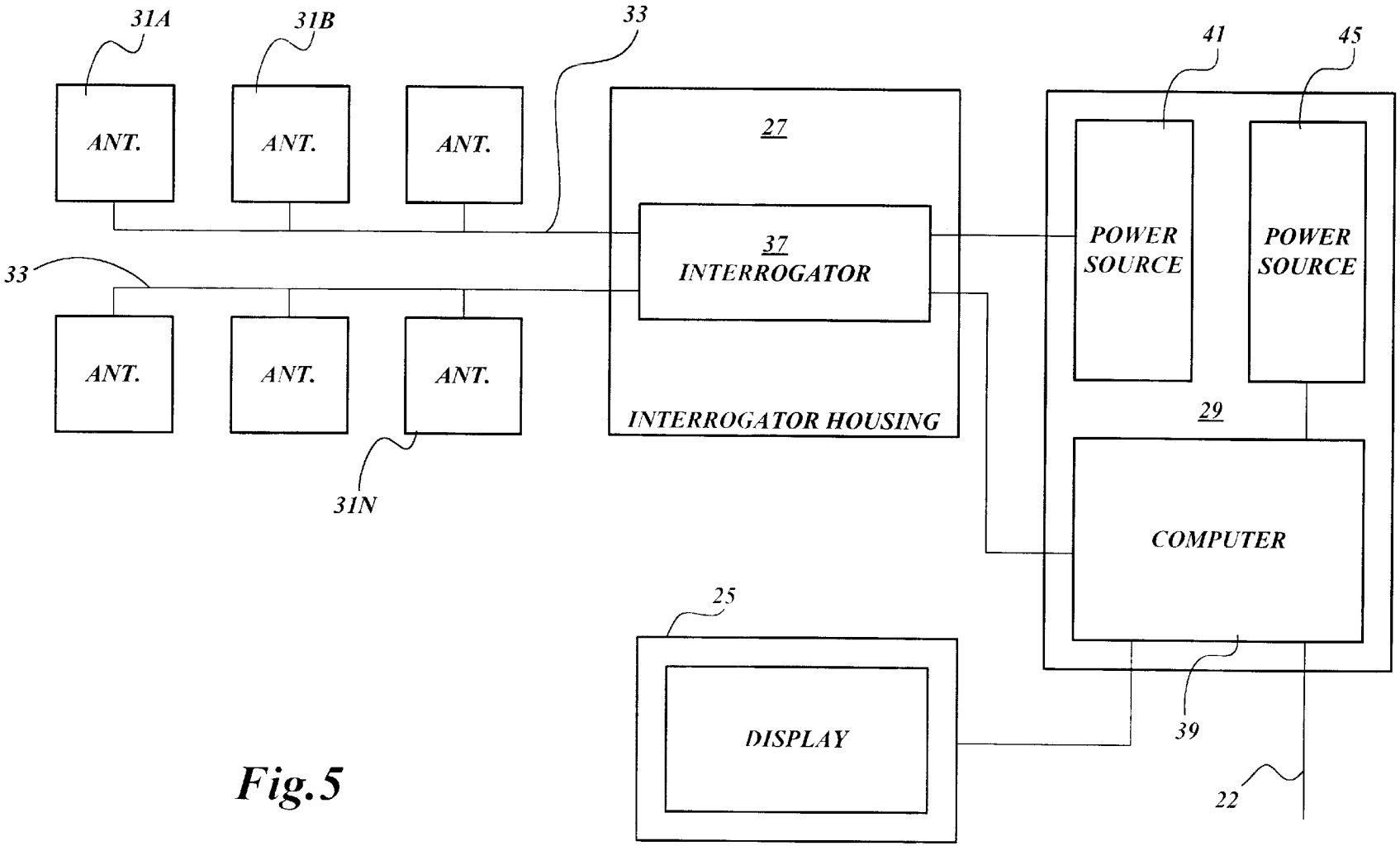
FIG. 5 is a block diagram illustrating the architecture of an RFID interrogator and computer utilized in an actual embodiment of the present invention.

As shown in FIG. 5, the antennas 31A–31N are connected to an RFID interrogator 37 via transmission lines 33. The RFID interrogator 37 is mounted within interrogator housing 27, which is attached to one of the columns 21B. The RFID interrogator 37 is connected to a power source 41. The RFID interrogator 37 is also connected to a computer 39 mounted in the computer housing 29. The computer 39 is also connected to a power source 45, which is also located in the computer housing 29. The computer 39 is also connected to the display 25 and to a base computer located at the parking lot via the phone line 22.

In operation, the RFID interrogator 37 continuously interrogates the region surrounding the column 21B. When a customer carrying an RFID tag comes within the interrogation area, the information contained in the RFID tag is read and decoded by the RFID interrogator 37. The RFID interrogator 37 supplies the read information to the computer 39, which transmits the information to the base computer via the phone line 22. The computer 39 also causes the display 25 to display information to waiting customers regarding the waiting time for the next courtesy bus. Arrival information is supplied to the computer 39 by the base computer located at the parking lot.

It should be appreciated by those skilled in the art that multiple parking lots having multiple base computers may be utilized. In such an embodiment of the invention, RFID tag data may be broadcast to each of the base computers when the RFID tag is read and decoded by the RFID interrogator 37. Each base computer may then determine whether the information encoded on the RFID tag corresponds to an entry in their particular parking lot database. If it does not, no action will be taken. If a corresponding entry is found, the courtesy bus will be dispatched as described above. Alternatively, the RFID tag may be encoded with information identifying the particular parking lot at which a customer parked their vehicle. When the RFID tag is read, the decoded information will only be transmitted to the base computer located at the particular parking lot identified in the encoded data.

Figure 6:
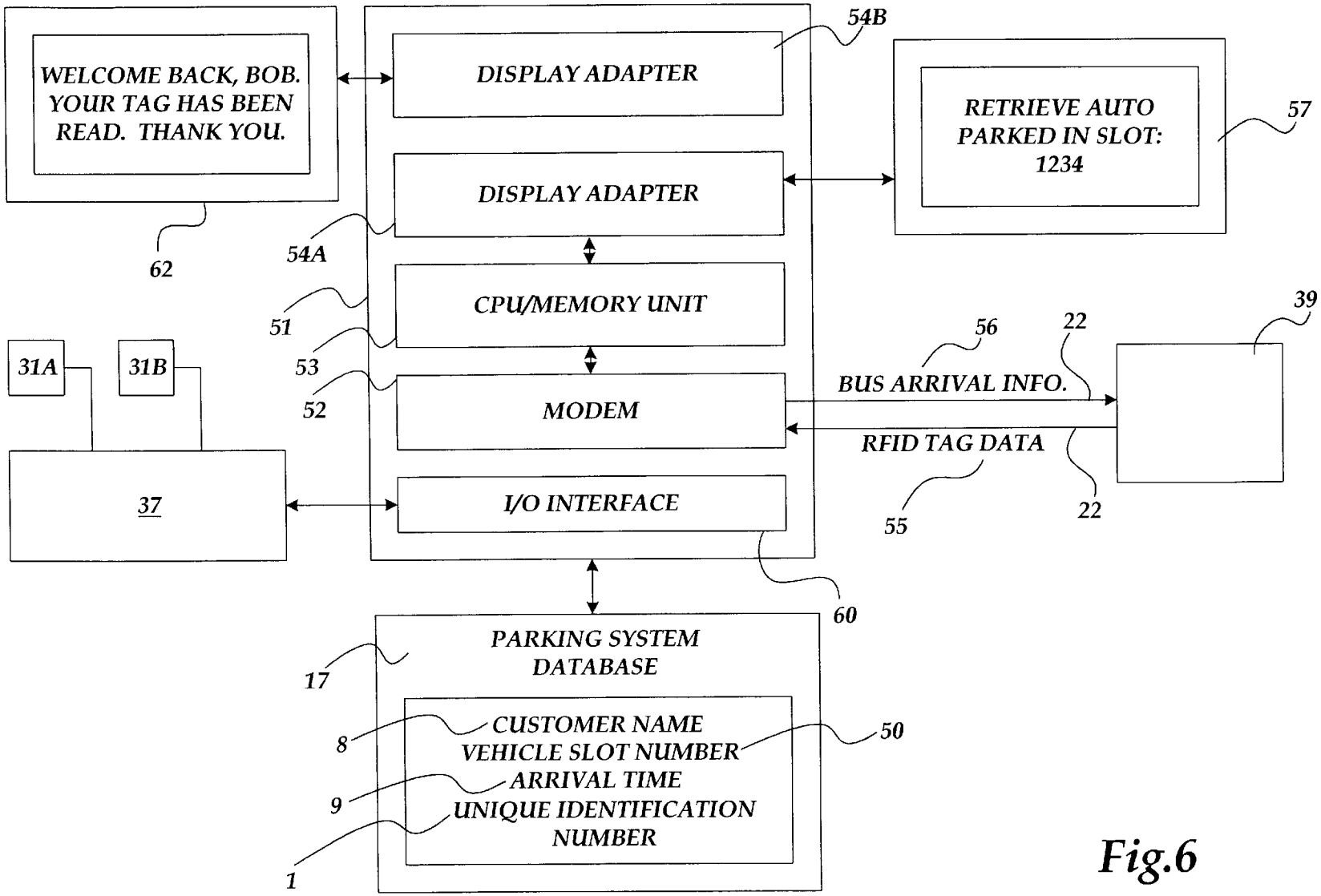
FIG. 6 is a block diagram illustrating the architecture of a base computer utilized in an embodiment of the present invention.

Referring now to FIG. 6, an illustrative base computer 51 will be described. The base computer 51 is located at the parking lot and comprises a cpu/memory unit 53 for controlling the operation of the base computer 51, a display adapter 54A for providing video signals to the display 57, and a modem 52 for communicating with the computer 39 via the phone line 22. The base computer 51 may also maintain a parking system database 4 on a non-volatile storage medium, for storing the customer name 8, the vehicle slot number 9, and the arrival time 50 for each customer. The base computer 51 may also comprise other conventional computing components not shown in FIG. 6.

In operation, the base computer 51 receives RFIG tag data 55 from the computer 39. When RFID tag data 55 is received, the base computer 51 retrieves the relevant data from the parking system database 4. The base computer 51 then displays the vehicle slot number 9 on the display 57 so that an attendant may retrieve the customer's vehicle from the appropriate slot and make the vehicle ready for the customer's arrival. The base computer 51 may also provide an alert to a dispatcher so that a courtesy bus may be sent to retrieve the customer. Alternatively, a communication may be made to a courtesy bus already en route to notify the bus that the customer should be picked up. Additionally, the base computer 51 transmits bus arrival information 56 to the computer 39. As described above, this bus arrival information is displayed for the benefit of the customer by the computer 39.

According to an embodiment of the present invention, the base computer 51 also includes an I/O interface 60 for communicating with an attached RFID interrogator 37. The RFID interrogator 37 is connected to antennas 31A–31B which are mounted proximate to the entrance to the parking lot. When a customer that was previously issued a RFID tag returns to the parking lot in their vehicle, the RFID interrogator 37 reads the information from the customer's RFID tag as they enter the parking lot. The parking system database 17 is then updated to indicate that the customer has arrived. The base computer 51 may also include a display adapter 54B for controlling display 62. The display 62 may also be mounted proximate to the entrance to the parking lot and utilized to provide an indication to the customer when they arrive that their RFID tag has been correctly read.

Figure 7:
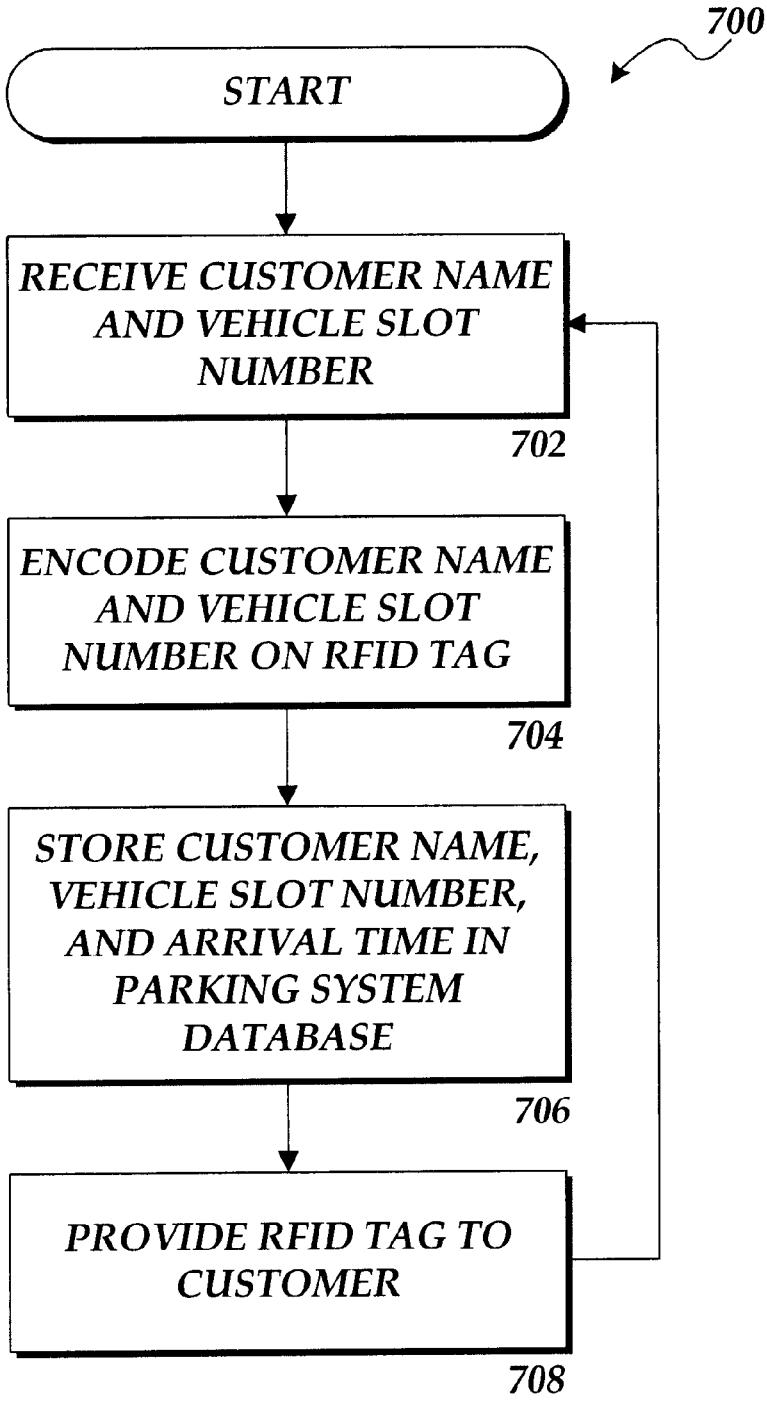
FIG. 7 is a flow diagram illustrating a routine for encoding a RFID tag according to an actual embodiment of the present invention.

Referring now to FIG. 7, an illustrative Routine 700 will be described for encoding an RFID tag with information uniquely identifying a customer. Routine 700 begins at block 702, where the customer name and vehicle slot number are received. This information may be provided by an attendant or by the customer. Routine 700 then continues from block 702 to block 704, where the customer's name and vehicle slot number are encoded on an RFID tag. Additional information may also be encoded on the RFID tag, such as the date and time of arrival of the customer, automobile make and model, and other such information. Alternatively, a unique identification number may be written to the RFID tag or, if the RFID tag was manufactured with a unique identification number, this number may be read from the RFID tag and stored in the parking system database. From block 704, the Routine 700 continues to block 706.

At block 706, the information uniquely identifying the customer are stored in the parking system database. According to an embodiment, the customer name, vehicle slot number, and arrival time are stored in the parking system database. Alternatively, the unique identification number may be stored in the parking system database as described above. As also described above, additional information may also be stored in the parking system database as known to those skilled in the art, such as the vehicle make, model, and color, license tag number, etc. Routine 700 then continues from block 706 to block 708, where the RFID tag is provided to the customer. The customer is instructed to keep the RFID tag in a safe place and to have it available when they return to the airport. According to an embodiment of the present invention, the customer is issued the RFID tag only once. The Routine 700 then returns to block 702, where the next RFID tag is encoded.

Figure 8A:
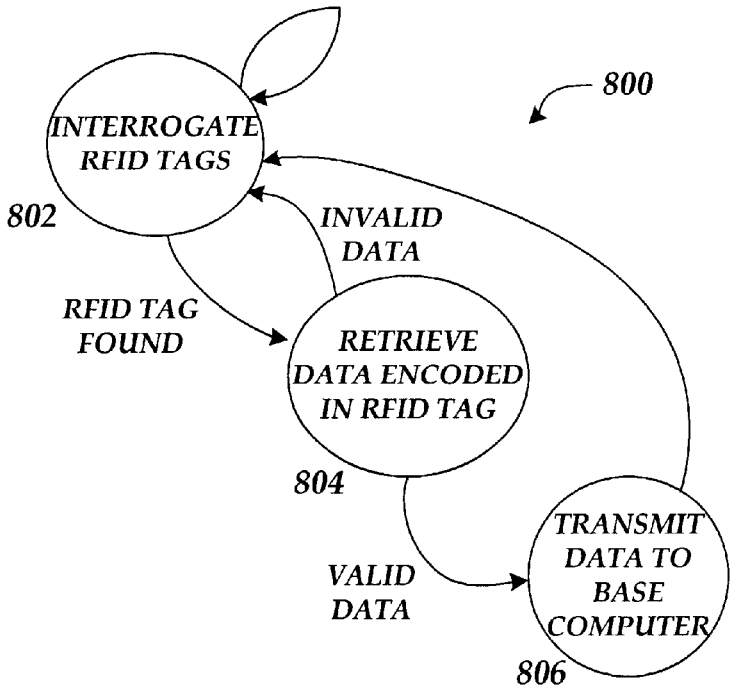
FIGS. 8A and 8B are state diagrams illustrating the operation of a RFID interrogator and interrogator computer according to an actual embodiment of the present invention.
Figure 8B:
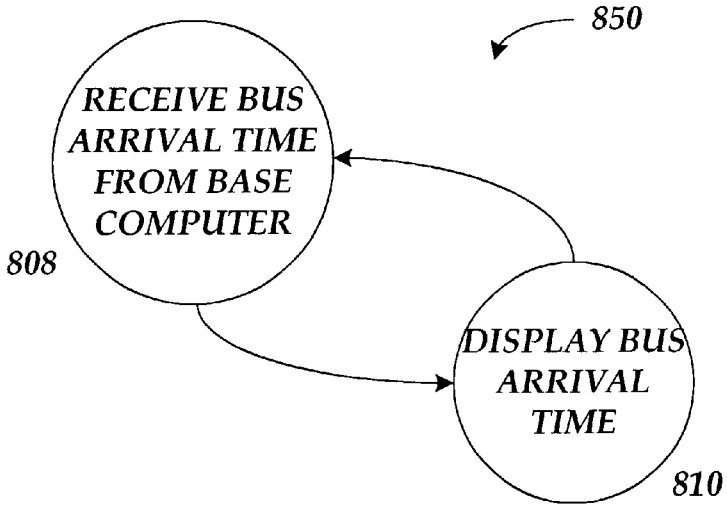

Referring now to FIGS. 8A and 8B, state diagrams 800 and 850 illustrating the operation of an illustrative RFID interrogator and a connected computer will be described. State diagram 800 begins at state 802, where the RFID interrogator continually interrogates RFID tags. If an RFID tag is found, the state diagram 800 moves from state 802 to state 804, where the data encoded in the RFID tag is retrieved and decoded. If the data is invalid, the state diagram returns to state 802 from state 804, and continues to decode RFID tags. If the data is valid, the state diagram moves from state 804 to state 806, where the RFID tag data is transmitted to the base computer located at the parking lot. Those skilled in the art should appreciate that most of the communication between the RFID interrogators and RFID tags is not reported by the interrogator to the local computer since most of the information is data sent to ensure that both the interrogator and the tag are present and functional. The state diagram then returns to state 802, where the RFID interrogator continues to interrogate RFID tags.

State diagram 850 begins at state 808, where bus arrival information is received at the interrogator computer from the base computer. When such information is received, the state changes from state 808 to 810. At state 810, the computer displays the bus arrival information on the display. As mentioned above, other types of information such as advertising may also be displayed by the computer.

Figure 9A:
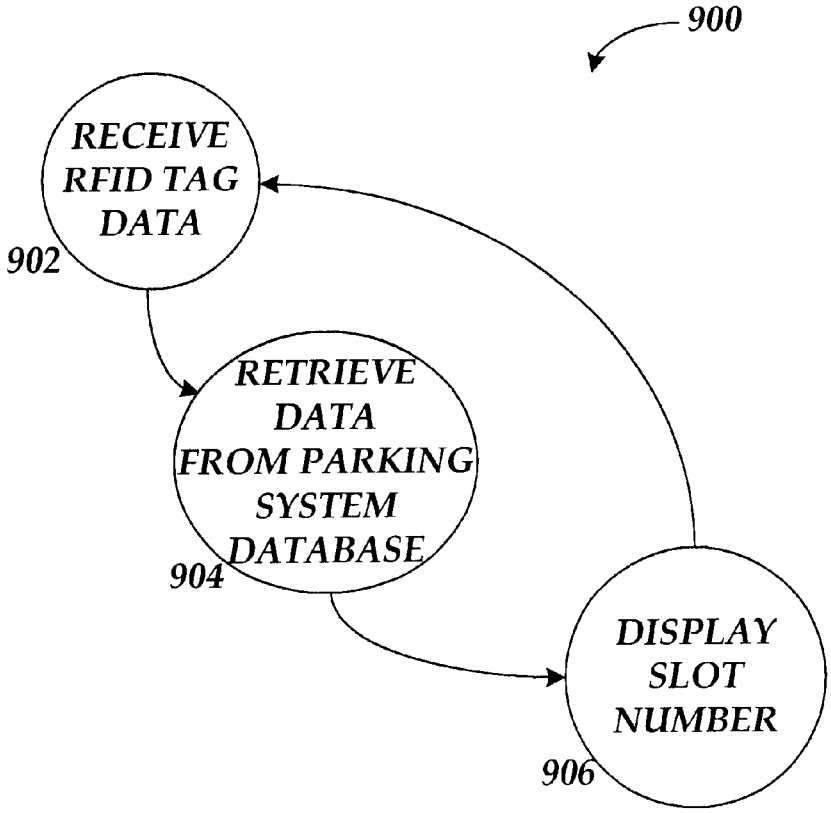
FIGS. 9A–9C are state diagrams illustrating the operation of a base computer according to an embodiment of the present invention.
Figure 9B:
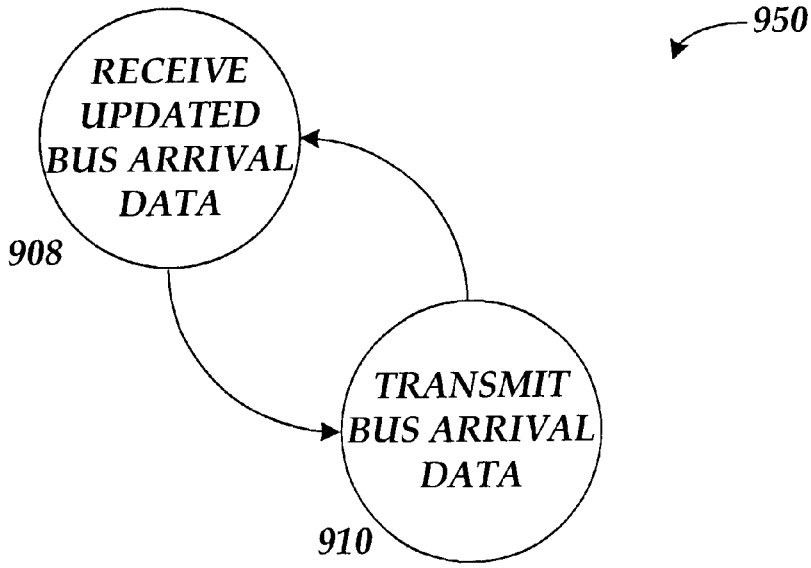

Referring now to FIGS. 9A and 9B, state diagrams 900 and 950 illustrating the operation of an illustrative base computer will be described. State diagram 900 begins at state 902, where RFID tag data is received at the base computer from the RFID interrogator. The state diagram 900 then moves to state 904, where data corresponding to the received RFID tag data is retrieved from the parking system database. The state diagram then moves to state 906, where the vehicle slot number is displayed. This information may be utilized by a parking attendant to retrieve the customers car. Additionally, a dispatcher may be notified by the base computer to dispatch a bus to retrieve the waiting customer. The state diagram then returns to state 902, where additional RFID tag data is received.

The state diagram 950 begins at state 908, where updated bus arrival data is received at the base computer. This data may be provided in an automated fashion or may be entered by hand into the base computer upon dispatch of a bus. The state diagram 950 then moves to state 910, where the bus arrival data is transmitted to the computer located at the airport. This information is then displayed by the computer for the customer's benefit. The routine 950 then returns to state 908, where further bus arrival data is received.

Figure 9C:
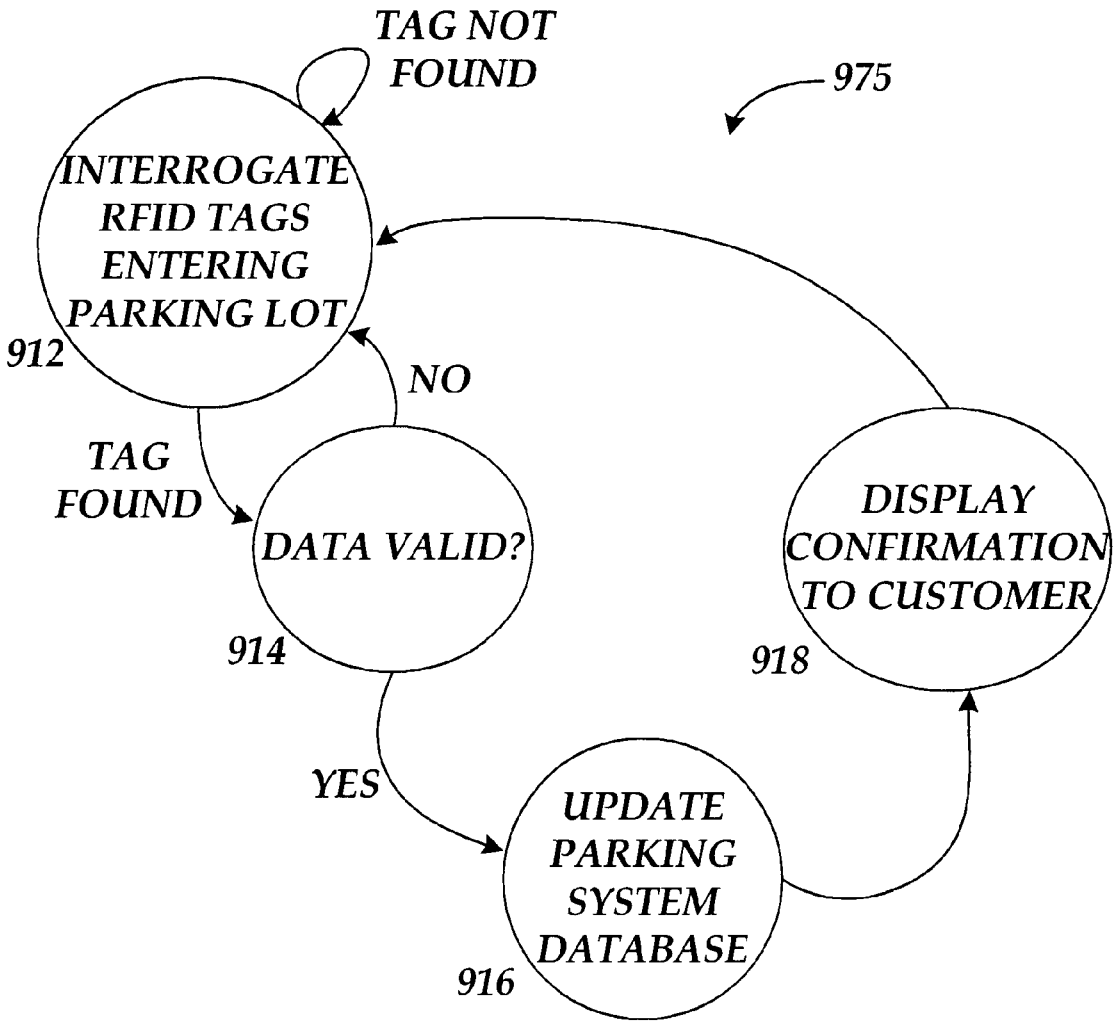

Referring now to FIG. 9C, additional aspects regarding the operation of the base computer according to an embodiment of the present invention will be described. As described briefly above, according to an embodiment of the present invention, the base computer is further equipped with a display mounted proximate to the entrance of the parking lot and an RFID interrogator also placed proximate to the entrance to the parking lot. State diagram 975 shown in FIG. 9C illustrates the further operation of the base computer in such an embodiment. State diagram 975 begins at state 912, where the area surrounding the entrance to the parking lot is interrogated for RFID tags. If an RFID tag is located, the state diagram 975 changes to state 914, where a determination is made as to whether the data decoded from the RFID tag is valid. If the data is not valid, the state returns to state 912. If the data is valid, the state continues to state 914.

At state 914, the parking system database is updated to include the information decoded from the RFID tag. In this manner, a customer who has been previously issued an RFID tag needs to take no actions when they return to the parking lot to ensure that the database correctly reflects that their vehicle has been parked in the lot. From state 916, the state diagram 975 continues to state 918, where the display located at the entrance to the parking lot is updated to display a confirmation to the customer that their RFID tag has been correctly decoded. The state diagram 975 then returns to state 912 where additional RFID tags are decoded. When the customer returns to the airport, their RFID tag is decoded at the terminal island and a courtesy bus is sent to retrieve them as described above.

In light of the above, it should be appreciated that the present invention provides an improved airport parking communication system. While an actual embodiment of the invention has been illustrated and described, it will be appreciated that various changes can be made therein without departing from the spirit and scope of the invention.

The embodiments of the invention in which an exclusive property or privilege is claimed are defined as follows:

1. A parking lot communication system, comprising:

an encoder for encoding, on a radio frequency identification tag, information identifying the location of a vehicle parked by or on behalf of a customer in a parking lot, the encoder encoding anew the information identifying the location of the vehicle each time the vehicle is parked by or on behalf of the customer in the parking lot;

an interrogator remotely located from said parking lot for retrieving said information identifying the location of a vehicle from said radio frequency identification tag when said tag is located within the reading proximity of said interrogator; and a base computer for displaying said information identifying the location of a vehicle and causing a pick-up vehicle to be dispatched to said remote location to pickup said customer.

2. The system of claim 1, further comprising one or more antennas connected to said interrogator for receiving said information identifying the location of a vehicle from said radio frequency identification tag.

3. The system of claim 2, further comprising a computer connected to said interrogator for receiving said information identifying the location of a vehicle from said interrogator and for transmitting said information to said base computer.

4. The system of claim 3, wherein said computer is located proximate to said interrogator and wherein said computer is further operative to receive data from said base computer and to display said data.

5. The system of claim 4, wherein said data received from said base computer comprises the arrival time of said pick-up vehicle.

6. The system of claim 5, wherein said information identifying the location of a vehicle comprises a vehicle slot number and wherein said radio frequency identification tag also includes said customer's name.

7. The system of claim 6, wherein said information identifying the location of a vehicle is stored in a parking system database.

8. The system of claim 7, wherein said information identifying the location of a vehicle further comprises an arrival time indicating the time at which a vehicle was parked in the vehicle slot number.

9. A method for displaying the location of a vehicle, comprising:

encoding, on a radio frequency identification tag, data identifying the location of a vehicle parked by or on behalf of a customer in a parking lot, the information identifying the location of the vehicle being encoded anew each time the vehicle is parked by or on behalf of the customer in the parking lot;

retrieving said data identifying the location of a vehicle from said radio frequency identification tag using a radio frequency interrogator located remotely from said parking lot when said customer brings said radio frequency identification tag within the reading proximity of said interrogator;

transmitting said retrieved data identifying the location of a vehicle to a base computer; and displaying said retrieved data identifying the location of a vehicle at said base computer, said base computer causing pick-up vehicle to be dispatched to said remote location to pick up said customer.

10. The method of claim 9, wherein data identifying the location of a vehicle comprises a vehicle slot number.

11. The method of claim 10, wherein said radio frequency identification tag is also encoded with the name of said customer.

12. The method of claim 9, wherein said radio frequency interrogator comprises an interrogator and one or more antennas connected to said interrogator for receiving data from said radio frequency identification tag.

13. The method of claim 12, further comprising:

receiving data from said base computer at a computer located proximate to said radio frequency interrogator; and displaying said received data.

14. The method of claim 13, wherein said data received from said base computer comprises the arrival time of a bus.

15. The method of claim 9, further comprising storing said information identifying the location of a vehicle in a parking system database.

16. The method of claim 14, wherein said parking system database comprises a customer name, a vehicle slot number, and an arrival time indicating the time at which a vehicle was parked in said vehicle slot number.

17. A method for dispatching a courtesy vehicle to retrieve a customer, so that the customer can pick up a vehicle parked by or on behalf of the customer in a parking lot comprising:

providing said customer with a radio frequency identification tag encoded with data that uniquely identifies said customer and with data that identifies the location of a vehicle parked by or on behalf of a customer in a parking lot;

decoding said encoded data from said radio frequency identification tag;

transmitting said decoded data to a base computer; and in response to receiving said encoded data at said base computer, said base computer causing a vehicle to be dispatched to retrieve said customer.

18. The method of claim 17, wherein said encoded data comprises a unique identification number.

19. The method of claim 18, further comprising:

displaying an estimated time of arrival indicating when said vehicle will arrive to retrieve said customer.

20. The method of claim 19, further comprising:

storing said data that uniquely identifies said customer in a database when said radio frequency identification tag is provided to said customer.

* * * * *

UNITED STATES PATENT AND TRADEMARK OFFICE

CERTIFICATE OF CORRECTION

PATENT NO. : 6,522,264 B1
DATED : February 18, 2003
INVENTOR(S) : G.M. Stewart

It is certified that error appears in the above-identified patent and that said Letters Patent is hereby corrected as shown below:

Title page,
Item [56], References Cited, U.S. PATENT DOCUMENTS, "6,163,275" should read -- 6,163,278 --

Column 7,
Line 63, "pickup" should read -- pick up --

Column 8,
Line 40, "causing pick-up" should read -- causing a pick-up --

Signed and Sealed this

Twenty-fifth Day of November, 2003

JAMES E. ROGAN
*Director of the United States Patent and Trademark Office*